US012765745B2

(12) United States Patent
Wahl

(10) Patent No.: US 12,765,745 B2
(45) Date of Patent: Oct. 20, 2026

(54) HOUSEHOLD APPLIANCE AND DISPENSER ASSEMBLY

(71) Applicant: WHIRLPOOL CORPORATION, Benton Harbor, MI (US)

(72) Inventor: Evan J. Wahl, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 50 days.

(21) Appl. No.: 18/611,112

(22) Filed: Mar. 20, 2024

(65) Prior Publication Data

US 2025/0295288 A1 Sep. 25, 2025

(51) Int. Cl.
*A47L 15/42* (2006.01)
*A47L 15/44* (2006.01)

(52) U.S. Cl.
CPC ..... *A47L 15/4445* (2013.01); *A47L 15/4257* (2013.01); *A47L 15/4463* (2013.01); *A47L 15/4472* (2013.01)

(58) Field of Classification Search
CPC ..... A47L 15/4257; A47L 15/4445
See application file for complete search history.

(56) References Cited

U.S. PATENT DOCUMENTS

| | | | | |
|---|---|---|---|---|
| 7,931,032 | B1 * | 4/2011 | Penkauskas | A47L 15/4463 134/94.1 |
| 11,098,436 | B2 | 8/2021 | Leibman | |
| 2005/0126608 | A1 | 6/2005 | DeWeerd et al. | |
| 2010/0212700 | A1 | 8/2010 | Wattley et al. | |
| 2013/0000781 | A1 * | 1/2013 | Bischoff | A47L 15/4472 141/330 |
| 2013/0133705 | A1 | 5/2013 | Classen et al. | |

FOREIGN PATENT DOCUMENTS

WO WO-2022194952 A1 * 9/2022

OTHER PUBLICATIONS

WO2022194952—Machine Translation (Year: 2022).*
European Patent Office, Extended European Search Report Re: Corresponding Application No. 25154795.6—1015, dated Jun. 30, 2025, 8 pages, Munich, Germany.

* cited by examiner

*Primary Examiner* — Levon J Shahinian
(74) *Attorney, Agent, or Firm* — Price Heneveld LLP

(57) ABSTRACT

A household appliance for treating articles according to a cycle of operation includes a chassis with an interior surface at least partially defining a treating chamber for receiving the articles according to the cycle of operation. A dispenser assembly can be provided with the household appliance and operably coupled to the interior surface. The dispenser can include a cartridge carrier configured to receive a cartridge with a treating chemistry reservoir.

16 Claims, 7 Drawing Sheets

HOUSEHOLD APPLIANCE AND DISPENSER ASSEMBLY

BACKGROUND

Contemporary appliances for use in a typical household include a cabinet with an interior tub, drum, or the like at least partially defining a treating chamber into which articles can be placed for treatment according to an automatic cycle of operation. Such articles can include kitchenware, glassware, or clothing items in some examples. A dispensing system can be provided for supplying treating chemistry to the treating chamber. A user interface can be provided for selecting, modifying, or otherwise controlling a cycle of operation of the household appliance.

BRIEF DESCRIPTION

In one aspect, the disclosure relates to a household appliance for treating articles according to an automatic cycle of operation, the household appliance comprising: a chassis having an interior surface at least partially defining a treating chamber for receiving the articles for treatment according to the automatic cycle of operation, the chassis including a door assembly having an inner door surface forming part of the interior surface of the chassis; and a dispenser assembly operably coupled to the interior surface, the dispenser assembly comprising: a cartridge receptacle having a rear wall from which extends a peripheral wall to define a cartridge recess with an open face opposite the rear wall; and a cartridge carrier defining a cartridge seat and movable between an operational position, where the cartridge seat faces the cartridge recess, and a load position, where the cartridge seat faces the open face.

In another aspect, the disclosure relates to a household appliance for treating articles according to an automatic cycle of operation, the household appliance comprising: a chassis having an interior surface at least partially defining a treating chamber for receiving the articles for treatment according to the automatic cycle of operation, the chassis including a door assembly having an inner door surface forming part of the interior surface of the chassis; and a dispenser assembly operably coupled to the interior surface, the dispenser assembly comprising: a cartridge receptacle having a rear wall from which extends a peripheral wall to define a cartridge recess with an open face opposite the rear recess wall; a cartridge carrier defining a cartridge seat with a first coupling and the cartridge carrier is movable between an operational position, where the cartridge seat faces the cartridge recess, and a load position, where the cartridge seat faces the open face; and a cartridge sized to fit within the cartridge recess and having a second coupling that couples with the first coupling to secure the cartridge within the cartridge seat.

DETAILED DESCRIPTION

The disclosure generally relates to a dispensing assembly for a household appliance. In typical household appliances, such as dishwashers, the treating chamber may include a dispenser chamber with a connected flip-top or rotatable lid, wherein a user supplies treating chemistry to the chamber and closes the lid prior to a cycle of operation.

Aspects of the dispensing assembly disclosed herein include a cartridge configured to secure to a housing, such as within the treating chamber, without need of a lid connected to the housing.

Figure 1:
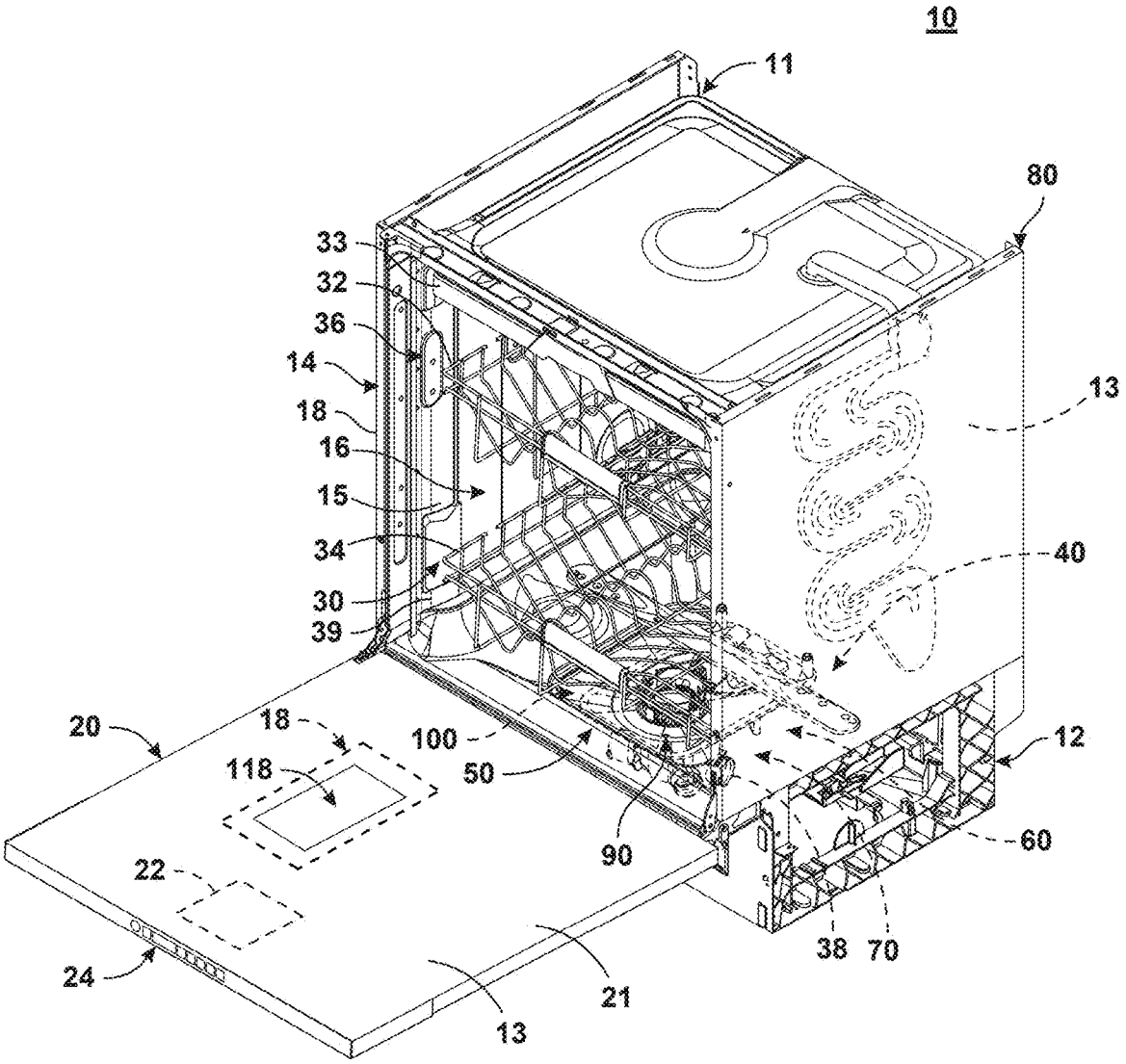
FIG. 1 is a right-side perspective view of an exemplary household appliance in the form of an automatic dishwasher having multiple systems for implementing an automatic cycle of operation.

FIG. 1 illustrates an exemplary household appliance 1 capable of implementing an automatic cycle of operation for treating articles. The household appliance 1 can include any suitable appliance such as a dishwasher, a steam treatment appliance, a clothes washer, a clothes dryer, a combination washer/dryer, or the like, in non-limiting examples.

In the illustrated example, the household appliance 1 is in the form of a dishwasher 10 for treating dishes. As used in this description, the term "dish(es)" or "dish item(s)" is intended to be generic to any item, single or plural, that can be treated in the dishwasher 10, including, without limitation, dishes, plates, pots, bowls, pans, glassware, or silverware. As illustrated, the dishwasher 10 is a built-in dishwasher implementation, which is designed for mounting under a countertop. However, this description is applicable to other dishwasher implementations such as a stand-alone, drawer-type or a sink-type, for example.

The dishwasher 10 has a variety of systems, some of which are controllable, to implement the automatic cycle of operation. A chassis 11 is provided to support the variety of systems needed to implement the automatic cycle of operation. The chassis 11 includes an interior surface 13 that at least partially defines a treating chamber 16. The treating chamber 16 includes an open face for receiving the articles for treatment according to the automatic cycle of operation. As illustrated, for a built-in implementation, the chassis 11 includes a frame in the form of a base 12, an open-faced tub 14 supported by the base 12, and a closure in the form of a door assembly 20. The door assembly 20 can be pivotally mounted to the base 12 for movement between opened and closed positions to selectively open and close the open face of the treating chamber 16, such as for loading and unloading of dishes or other items.

The tub 14 includes a tub surface 15 at least partially defining the treating chamber 16. The door assembly 20 includes an inner door surface 21 at least partially defining the treating chamber 16. In this manner, the interior surface 13 can include at least one of the tub surface 15 or the inner door surface 21.

The chassis 11, as in the case of the built-in dishwasher implementation, can be formed by portions of the dishwasher 10, such as the tub 14 and the door assembly 20, in addition to a dedicated frame structure, like the base 12, with them all collectively forming a unibody frame to which the variety of systems are supported. In other implementations such as a drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis 11, while essentially limitless, can include a dish holding system 30, a spray system 40, a recirculation system 50, a drain system 60, a water supply system 70, a drying system 80, a heating system 90, and a filter system 100. These systems are used to implement one or more treating cycles of operation for the dishes, for which there are many, and one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The wash phases and rinse phases can include the heating of the water, even to the point of one or more of the phases being hot enough for long enough to sanitize the dishes. A drying phase can follow the rinse phase(s). The drying phase can include a drip dry, heated dry, condensing dry, air dry or any combination.

A controller 22 can also be included in the dishwasher 10 and operably couples with and controls the various components of the dishwasher 10 to implement the cycle of operation. The controller 22 can be located within the door assembly 20 as illustrated, or it can alternatively be located somewhere within the chassis 11. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information.

The dish holding system 30 can include any suitable structure for holding dishes within the treating chamber 16. Exemplary dish holders are illustrated in the form of an upper dish rack 32 and a lower dish rack 34, commonly referred to as "racks", which are located within the treating chamber 16. The upper dish rack 32 and the lower dish rack 34 are typically mounted for slidable movement in and out of the treating chamber 16 through the open face for ease of loading and unloading. Drawer guides 36, which can include slides or rails, are typically used to slidably mount the upper dish rack 32 to the tub 14. The lower dish rack 34 typically has wheels or rollers 38 that roll along rails 39 formed in sidewalls of the tub 14 and onto the door assembly 20 when the door assembly 20 is in the opened position.

Dedicated dish holders can also be provided. One such dedicated dish holder is a third-level rack 33 located above the upper dish rack 32. Like the upper dish rack 32, the third-level rack is slidably mounted to the tub 14 with drawer guides 36. The third-level rack 33 is typically used to hold utensils, such as tableware, spoons, knives, spatulas, etc., in an on-the-side or flat orientation. However, the third-level rack 33 is not limited to holding utensils. If an item can fit in the third-level rack 33, it can be washed in the third-level rack 33. The third-level rack 33 generally has a much shorter height or lower profile than the upper and lower dish racks 32, 34. Typically, the height of the third-level rack 33 is short enough that a typical glass cannot be stood vertically in the third-level rack 33 within the treating chamber 16.

Another dedicated dish holder can be a silverware basket (not shown), which is typically carried by one of the upper or lower dish racks 32, 34 or mounted to the door assembly 20. Such a silverware basket typically holds utensils and the like in an upright orientation as compared to the on-the-side or flat orientation of the third-level rack 33.

A dispensing system 18 is provided to dispense one or more types of treating chemistries, e.g., detergent, anti-spotting agent, etc., into the treating chamber 16. The dispensing system 18 can include at least a treating chemistry reservoir and a dispenser outlet. The dispenser assembly 118 can include a single-use dispenser, or a bulk dispenser, or a combination of both in some implementations.

The dispensing system 18 can also include a dispenser assembly 118 operably coupled to the interior surface 13 of the treating chamber 16. In the illustrated example, the dispenser assembly 118 is coupled to the inner door surface 21 though this need not be the case. The dispenser assembly 118 can also be coupled to the tub surface 15 in some implementations. It is also contemplated that multiple dispenser assemblies 118 can be provided, including on the inner door surface 21 or the tub surface 15.

Figure 2:
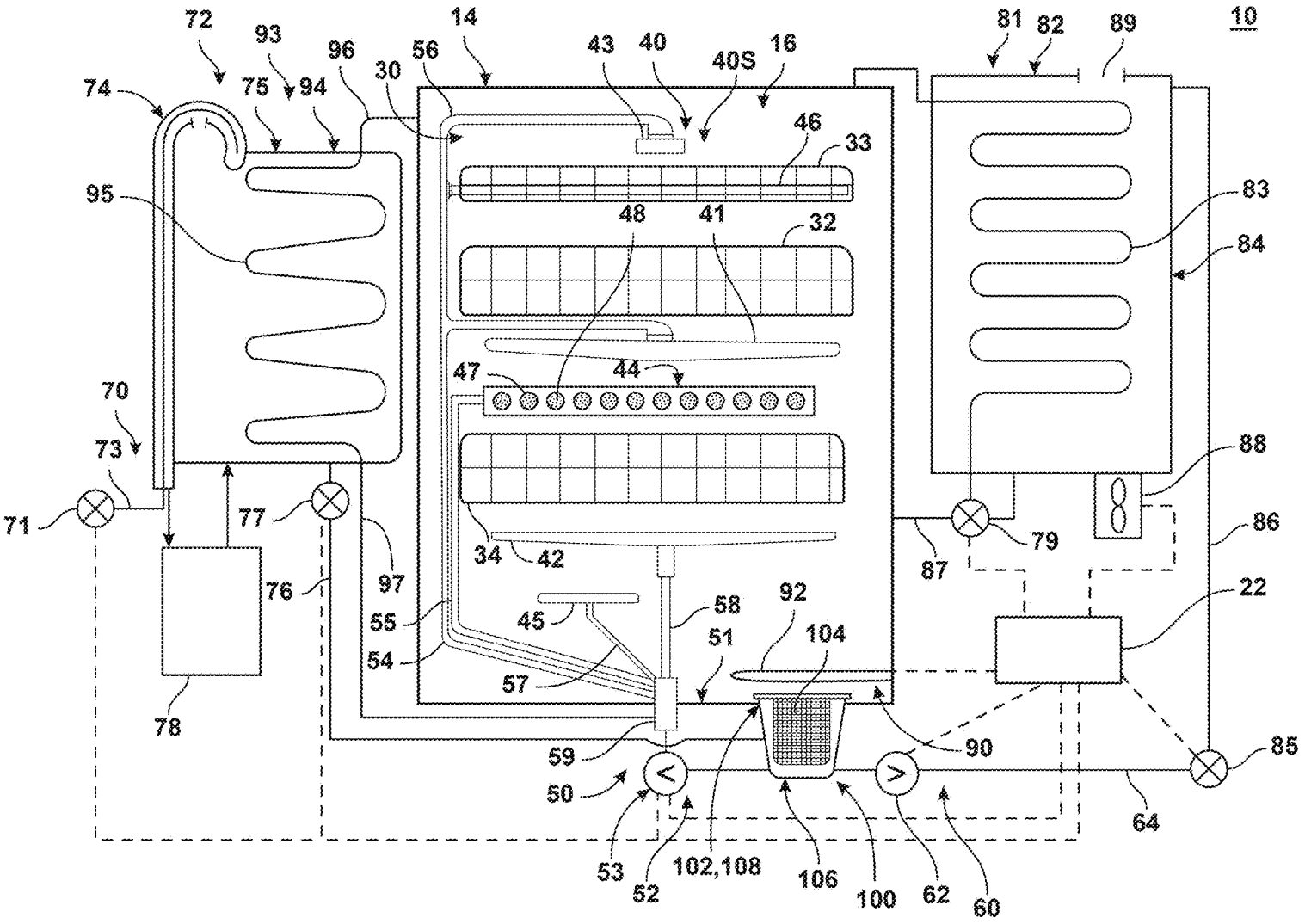
FIG. 2 is a schematic front view of the household appliance of FIG. 1 illustrating some exemplary plumbing and electrical connections between at least some of the multiple systems.

Turning to FIG. 2, the spray system 40 is provided for spraying liquid in the treating chamber 16 and can have a set of spray assemblies or sprayers 40S, some of which can be dedicated to a particular one of the dish holders, to a particular area of a dish holder, to a particular type of cleaning, or to a particular level of cleaning, etc. The set of sprayers 40S can be fixed or movable, such as rotating, relative to the treating chamber 16 or dish holder. Six exemplary sprayers are illustrated in the set of sprayers 40S and include an upper spray arm 41, a lower spray arm 42, a third-level sprayer 43, a deep-clean sprayer 44, a spot sprayer 45, and a tube sprayer 46. The upper spray arm 41 and lower spray arm 42 are rotating spray arms, located below the upper dish rack 32 and lower dish rack 34, respectively, and rotate about a generally centrally located and vertical axis. The third-level sprayer 43 is located above the third-level rack 33. The third-level sprayer 43 is illustrated as being fixed, but could move, such as in rotating. In addition to the third-level sprayer 43 or in place of the third-level sprayer 43, the tube sprayer 46 can be located at least in part below a portion of the third-level rack 33. The tube sprayer 46 is illustrated as a fixed tube, carried by the third-level rack 33, but could be movable, such as by rotating about a longitudinal axis.

The deep-clean sprayer 44 is a manifold extending along a rear wall of the tub 14 and has multiple nozzles 47, with multiple apertures 48, generating an intensified and/or higher pressure spray than the upper spray arm 41, the lower spray arm 42, or the third-level sprayer 43. The nozzles 47 can be fixed or move, such as in rotating. The spray emitted by the deep-clean sprayer 44 defines a deep clean zone, which, as illustrated, would like along a rear side of the lower dish rack 34. Thus, dishes needing deep cleaning, such as dishes with baked-on food, can be located in the lower dish rack 34 to face the deep-clean sprayer 44. The deep-clean sprayer 44, while illustrated as only one unit on a rear wall of the tub 14 could include multiple units and/or extend along multiple portions, including different walls, of the tub 14, and can be provide above, below or beside any of the dish holders with deep-cleaning is desired.

The spot sprayer 45, like the deep-clean sprayer 44, can emit an intensified and/or higher pressure spray, especially to a discrete location within one of the dish holders. While the spot sprayer 45 is shown below the lower dish rack 34, it could be adjacent any part of any dish holder or along any wall of the tub where special cleaning is desired. In the illustrated location below the lower dish rack 34, the spot sprayer 45 can be used independently of or in combination with the lower spray arm 42. The spot sprayer 45 can be fixed or movable, including by rotating.

The upper spray arm 41, lower spray arm 42, third-level sprayer 43, deep-clean sprayer 44, spot sprayer 45, and tube sprayer 46 are illustrative examples of suitable sprayers and are not meant to be limiting as to the type of suitable sprayers in the set of sprayers 40S.

The recirculation system 50 recirculates the liquid sprayed into the treating chamber 16 by the sprayers of the spray system 40 back to the sprayers to form a recirculation loop or circuit by which liquid can be repeatedly and/or continuously sprayed onto dishes in the dish holders. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps such as a recirculation pump 53. The sump 51 can also be a separate module that is affixed to the bottom wall and include the pump assembly 52.

Multiple liquid supply conduits 54, 55, 56, 57, 58 fluidly couple the set of sprayers 40S to the recirculation pump 53. A recirculation valve 59 can selectively fluidly couple each of the conduits 54-58 to the recirculation pump 53. While each sprayer in the set of sprayers 40S is illustrated as having a corresponding dedicated supply conduit 54-58, two or more sprayers in the set of sprayers 40S can be supplied by the same conduit, negating the need for a dedicated conduit for each sprayer. For example, a single conduit can supply the upper spray arm 41 and the third-level sprayer 43. Another example is that the tube sprayer 46 is supplied liquid by the conduit 56, which also supplies the third-level sprayer 43.

The recirculation valve 59, while illustrated as a single valve, can be implemented with multiple valves. Additionally, one or more of the conduits can be directly coupled to the recirculation pump 53, while one or more of the other conduits can be selectively coupled to the recirculation pump with one or more valves. There are essentially an unlimited number of plumbing schemes to connect the recirculation system 50 to the spray system 40. The illustrated plumbing is not limiting.

The drain system 60 drains liquid from the treating chamber 16. The drain system 60 includes a drain pump 62 fluidly coupled the treating chamber 16 to a drain line 64. As illustrated the drain pump 62 fluidly couples the sump 51 to the drain line 64.

While separate recirculation and drain pumps 53, 62 are illustrated, a single pump can be used to perform both the recirculating and the draining functions. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to some extent.

The water supply system 70 is provided for supplying fresh water to the dishwasher 10 from a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 is provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

The drying system 80 is provided to aid in the drying of the dishes during the drying phase. The drying system as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60 or water supply system 70 such that liquid can be supplied to the cooling tank 84. The liquid provided to the cooling tank 84 from any of the systems 40-70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater, located in the treating chamber 16 at a location where it will be immersed by the water supplied to the treating chamber 16. The heater 92 need not be an immersion heater, it can also be an in-line heater located in any of the conduits. There can also be more than one heater 92, including both an immersion heater and an in-line heater.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of either or both of the coarse filter 102 and fine filter 104. Other filter arrangements are contemplated such as an ultra-filtration system.

Figure 3:
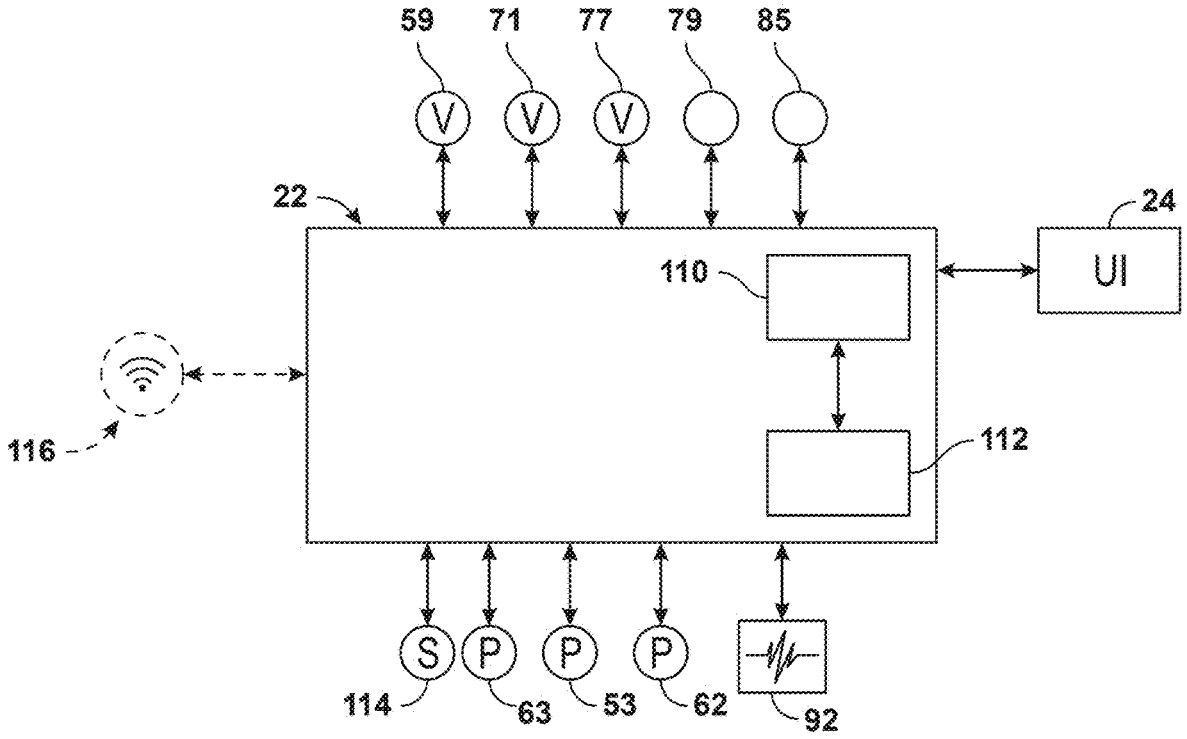
FIG. 3 is a schematic view of a controller of the household appliance of FIG. 1.

As illustrated schematically in FIG. 3, the controller 22 can be coupled with the heater 92 for heating the wash liquid during a cycle of operation, the drain pump 62 for draining liquid from the treating chamber 16 (FIG. 2), a dispenser pump 63 for drawing out treating chemistry from the dispenser assembly 118, and the recirculation pump 53 for recirculating the wash liquid during the cycle of operation. The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store one or more pre-programmed automatic cycles of operation that can be selected by a user and executed by the dishwasher 10. The controller 22 can also receive input from one or more sensors 114. Non-limiting examples of sensors that can be communicably coupled with the controller 22 include, to name a few, ambient air temperature sensor, treating chamber temperature sensor, water supply temperature sensor, door open/close sensor, and turbidity sensor to determine the soil load associated with a selected grouping of dishes, such as the dishes associated with a particular area of the treating chamber. The controller 22 can also communicate with the recirculation valve 59, the household water valve 71, the controllable valve 77, the return valve 79, and the valve 85. Optionally, the controller 22 can include or communicate with a wireless communication device 116.

Figure 4:
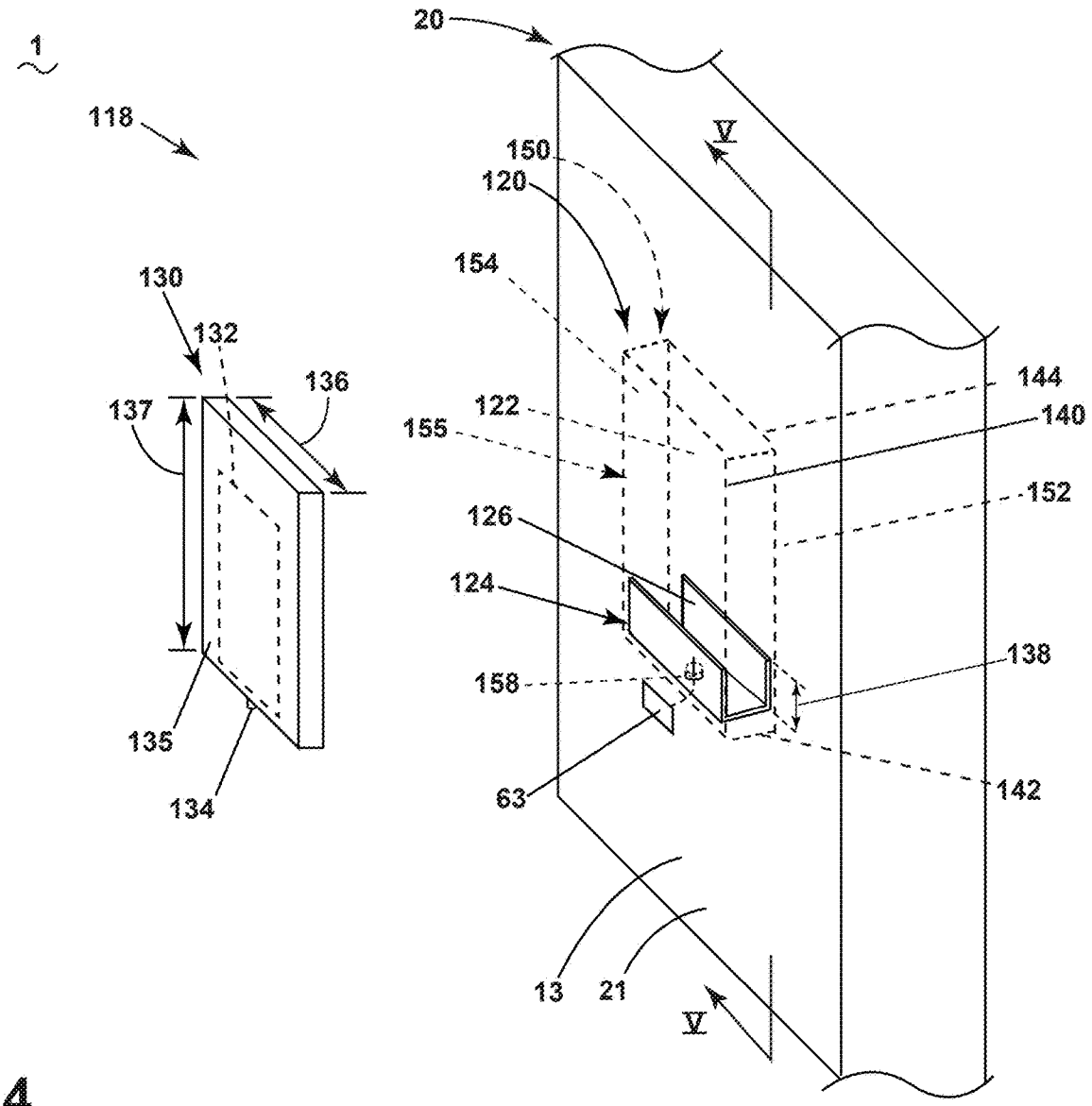
FIG. 4 is a schematic front view of a dispenser assembly suitable for use in the household appliance of FIG. 1 and illustrating a cartridge and a cartridge seat in accordance with various aspects described herein.

In FIG. 4 a portion of the door assembly 20 is shown with the dispenser assembly 118 in accordance with various aspects described herein. While the dispenser assembly 118 is shown located in the door assembly 20, it can be located relative to any surface forming part of or fluidly connected to the treating chamber 16 (FIG. 2). The dispenser assembly 118 includes a cartridge receptacle 120 a cartridge carrier 124, and a cartridge 130.

The cartridge receptacle 120 includes a cartridge recess 150 (shown in dashed lines for visual clarity) having a rear wall 152 and a recess top wall 144. Extending from the rear wall 152 is a peripheral wall 155 which includes a recess bottom wall 142, and a recess sidewall 154 defining an open face 140 opposite the rear wall 152. As shown, the cartridge recess 150 is located in the inner door surface 21 though this need not be the case. In some implementations, the cartridge recess 150 can be located in any portion of the interior surface 13, including the tub surface 15 (FIG. 1). Further, the cartridge recess 150 has a height that is measured from the recess bottom wall 142 to the recess top wall 144. In other implementations, the cartridge receptacle 120 can include an outer housing wall defining the cartridge recess 150 and mountable to the interior surface 13.

A cartridge carrier 124 is also provided within the cartridge receptacle 120. In the example shown, the cartridge carrier 124 includes a platform 122 and further defines a cartridge seat 126 for receiving a cartridge 130. The cartridge carrier 124 has a height 138 as shown. The height 138 of the cartridge carrier 124 is less than 50% of the height of the cartridge recess 150.

The cartridge 130 includes at least one treating chemistry reservoir 132 (shown in dashed lines) for containing any suitable amount of treating chemistry, including a single dose or charge, or multiple doses or charges. The cartridge 130 can also include a second coupling 134 fluidly coupled to the treating chemistry reservoir 132. The second coupling 134 can extend or project from the cartridge 130, as shown in the illustrated example, or can also be positioned along or within the cartridge 130 in some implementations. The cartridge 130 has a front cartridge wall 135 defining a front surface of the cartridge 130. Additionally, the cartridge 130 defines a cartridge width 136 and a cartridge height 137 as shown. The cartridge width 136 can be the same as, smaller than, or larger than the cartridge height 137. Further, the cartridge 130 is sized to fit within the cartridge recess 150.

The dispenser pump 63 (also referred to herein as "pump") and a first coupling 158 (shown in dashed lines) are also provided. The pump 63 can be carried by the cartridge receptacle 120 or a conduit of the pump 63 can be carried by the cartridge receptacle 120, as shown. The first coupling 158 can be disposed along the cartridge seat 126 as shown. Additionally or alternatively, one or more first couplings 158 can be disposed on the inner door surface 21 spaced from the cartridge recess 150, or on a surface having no such recess. The first coupling 158 is fluidly coupled to the pump 63, such as by a fluid conduit, tubing, or the like. However, it is contemplated in a non-limiting example, that the pump 63 can fluidly couple to one of the first coupling 158 or second coupling 134. The first coupling 158 is also configured to couple with the second coupling 134 of the cartridge 130. For instance, either or both of the first coupling 158 or the second coupling 134 can include a piercing end, a cannula, a membrane, a press-fit connector, a valve, a seal, or the like. Further, the second coupling 134 couples with the first coupling 158 can secure the cartridge 130 within the cartridge seat 126. That is, the first coupling 158 and the second coupling 134 are fluid couplings that establish fluid communication between the cartridge 130 and the household appliance 1. In another non-limiting example, one of the first coupling 158 or second coupling 134 is a cannula and the other of the first coupling 158 and the second coupling 134 is a seal through which the cannula passes. More specifically, the seal can be a membrane in which the cannula passes through to access the treating chemistry reservoir 132.

Figure 5:
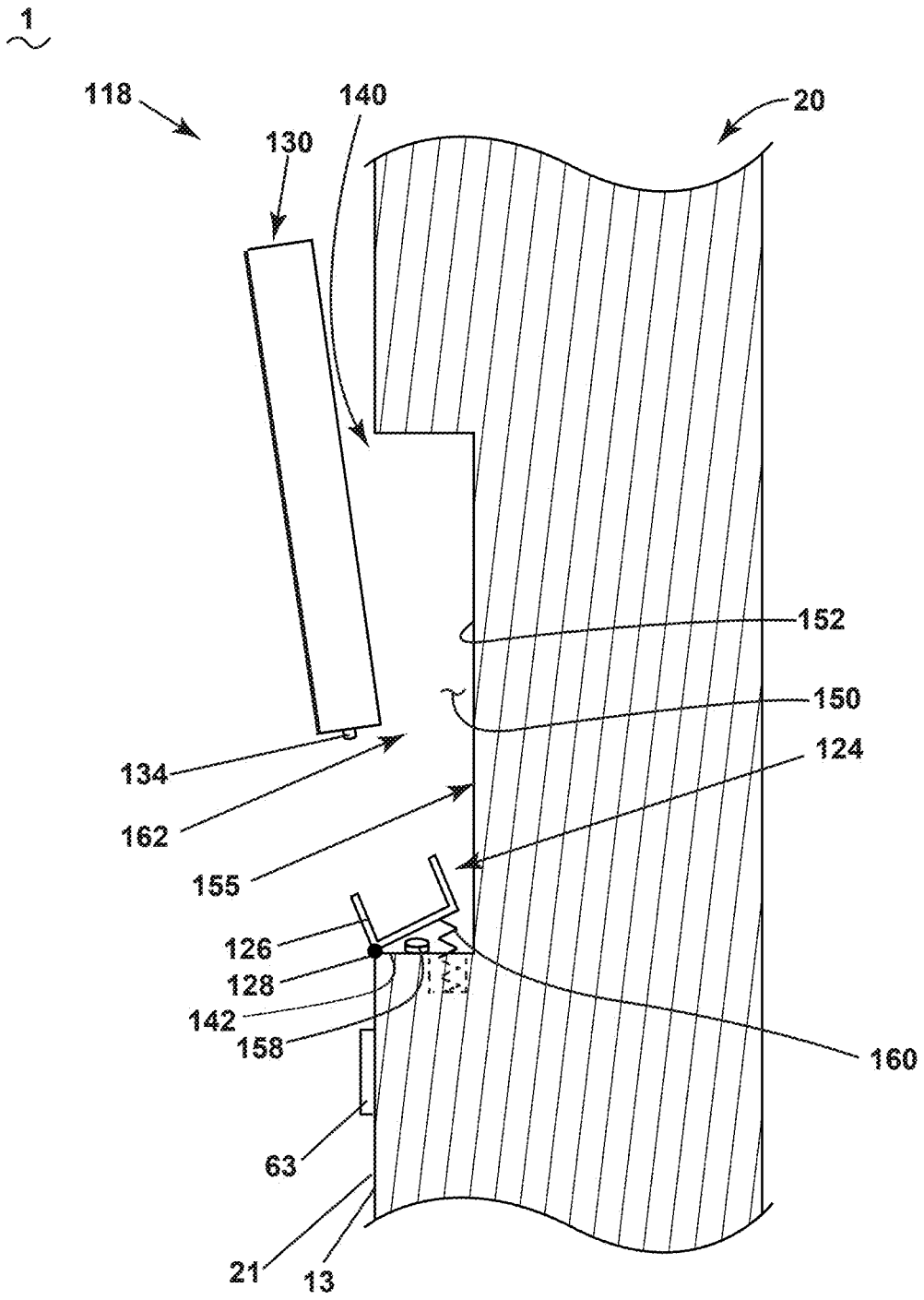
FIG. 5 is a schematic, cross-sectional view of the dispenser assembly of FIG. 4 along line V-V during insertion of the cartridge into the cartridge seat.
Figure 6:
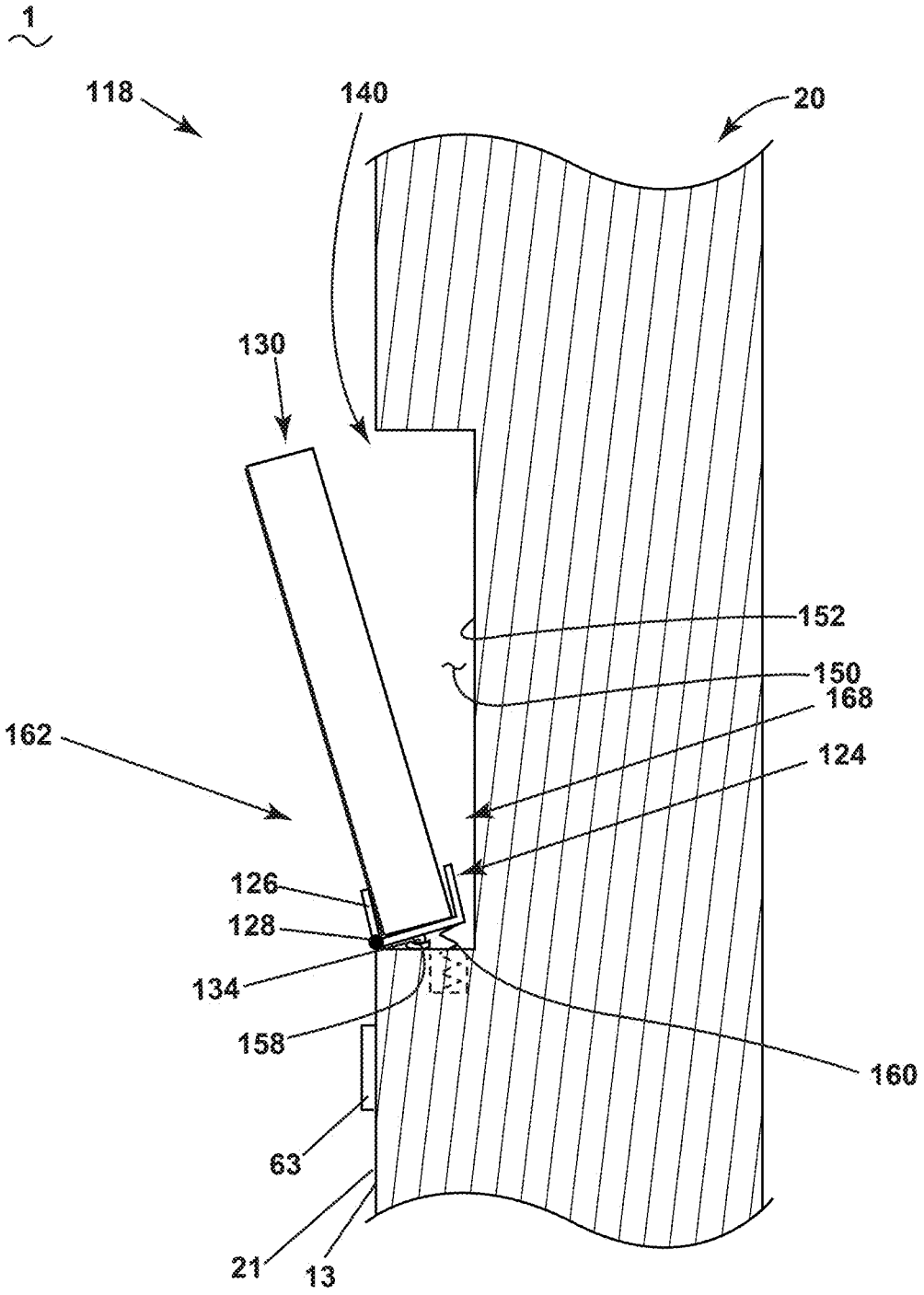
FIG. 6 is similar to FIG. 5 and illustrating the cartridge in a seated position.
Figure 7:
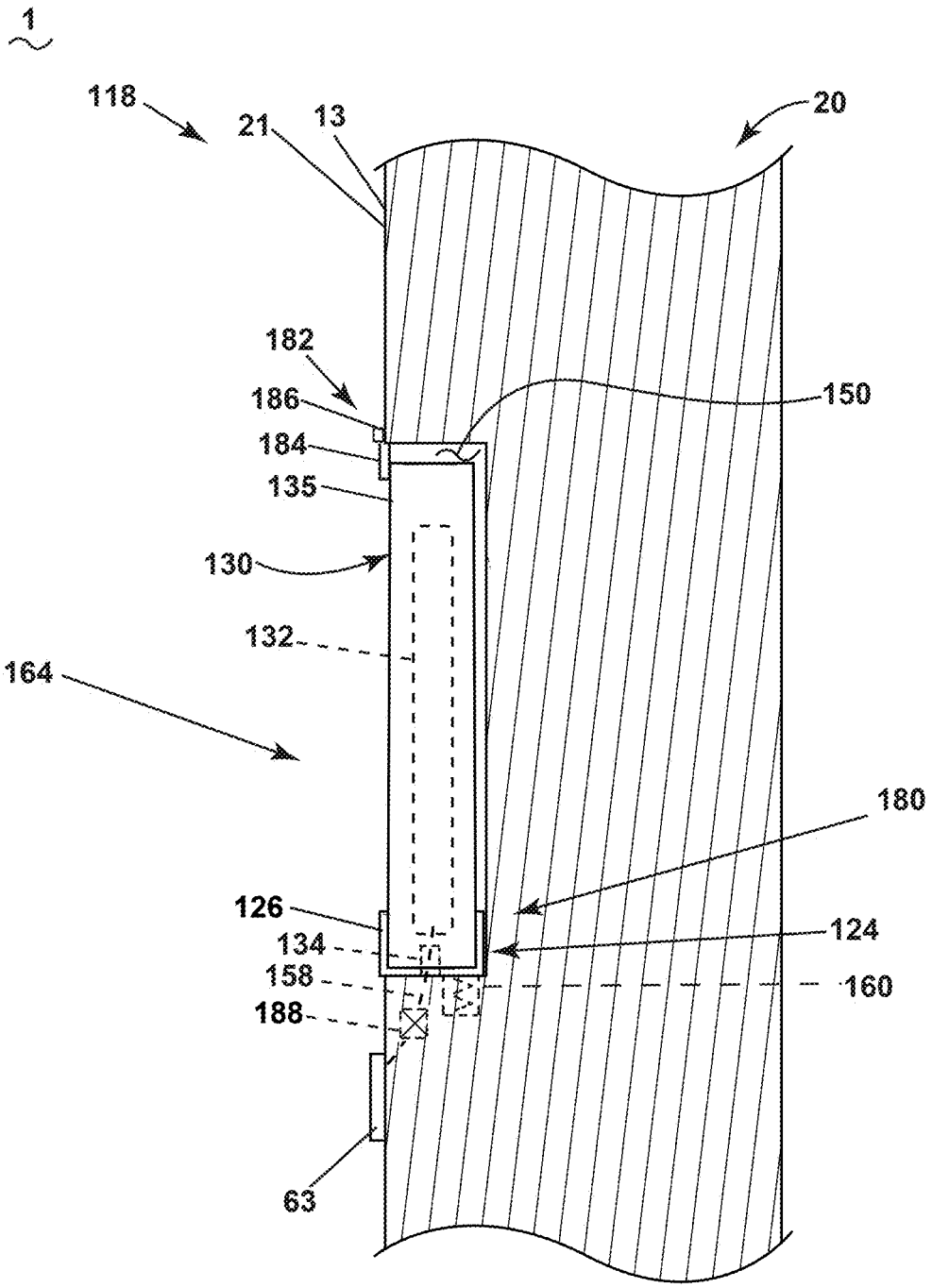
FIG. 7 is a cross-sectional view of the dispenser assembly of FIG. 4, similar to FIGS. 5-6, and illustrating the dispenser assembly in a dispensing position.

FIGS. 5-7 illustrate the relative positions of the cartridge 130 and cartridge carrier 124 during the loading of the cartridge 130. In general, FIG. 5 shows the cartridge 130 in a loading position relative to the cartridge carrier 124; FIG. 6 shows the cartridge 130 loaded/seated within the cartridge carrier 124; and FIG. 7 shows the cartridge carrier 124, with the loaded/seated cartridge 130, in an operational position. These different positions will now be described in greater detail.

Turning to FIG. 5, a cross-sectional view illustrates the cartridge 130 prior to insertion into the cartridge carrier 124, and with the cartridge seat 126 in the load position 162. In the non-limiting example shown, the cartridge carrier 124 is pivotally mounted to the dispenser assembly 118. More specifically, the cartridge carrier 124 is hingedly mounted to the peripheral wall 155 by a pivot coupling 128. Such a pivot coupling 128 can include a hinge, tether, or other suitable fastener.

A biasing device 160 can be provided and operably coupled to the cartridge carrier 124 for biasing the cartridge carrier 124 toward a predetermined position. For instance, the biasing device 160 can include an elastic component, a push-push latch, a deformable component, or the like. In the non-limiting example shown, the biasing device 160 includes a spring that partially extends into the recess bottom wall 142 and biases the cartridge carrier 124 away from the rear wall 152, toward the load position 162, though this need not be the case. In some examples, the biasing device 160 can bias the cartridge seat 126 toward the rear wall 152. In some implementations, the biasing device 160 can be incorporated into the pivot coupling 128, such as by a spring hinge or the like, or can include a push-push latch for selective biasing of the cartridge seat 126. In a non-limiting example, the biasing device 160 can be provided for biasing the cartridge 130 away from the first coupling 158, such as a "pop-up" style arrangement. Further still, the cartridge carrier 124 and the cartridge 130 can be freely movable with no biasing device present.

It is contemplated that the cartridge 130 is accessible for unseating from the cartridge seat 126 when the cartridge carrier 124 is in the load position 162. In this manner, the load position 162 allows for user access to the cartridge 130 or interior portions of the cartridge receptacle 120.

Turning to FIG. 6, the dispenser assembly 118 is shown with the cartridge 130 in the seated position 168. In the illustrated example the cartridge carrier 124 is in the load position 162, with the cartridge seat 126 facing the open face 140. In this manner, the dispenser assembly 118 can also define the load position 162 with the cartridge 130 in the seated position 168.

FIG. 7 illustrates the dispenser assembly 118 with the cartridge 130 in the seated position 168 and with the cartridge carrier in the operational position 164. In the illustrated example, a front wall of the cartridge 130 is aligned, flush, or coplanar with the interior surface 13, e.g. the inner door surface 21, which corresponds to the operational position 164. However, in some implementations, the cartridge 130 can project or protrude from the interior surface 13.

Still referring to FIG. 7, the dispenser assembly 118 can include latch assembly 182. The latch assembly 182 can include a first latch portion 184 that can be coupled to the cartridge 130 and can include a second latch portion 186 that can be coupled to the interior surface 13, such as to the inner door surface 21. The first latch portion 184 can selectively latch with the second latch portion 186 to at least temporarily latch the cartridge 130 in the operational position 164. It is contemplated in a non-limiting example, that the latch assembly 182 can include a push-push latch, a push button, a slide to release mechanism, an electronic latch release, or a combine thereof.

During operation, the cartridge 130 can be inserted into or removed from the cartridge receptacle 120 when the dispenser assembly 118 is in the load position 162 (FIGS. 5 and 6). The cartridge seat 126 can be configured to align the second coupling 134 of the cartridge 130 with the first coupling 158 and fluidly couple the pump 63, when inserting the cartridge 130 (FIG. 5). That is, the pump 63 is fluidly coupled to the cartridge seat 63 in at least the operational position. Once the cartridge 130 is in the seated position 168 (FIG. 6) within the cartridge seat 126, the cartridge 130 with the cartridge carrier 124 can be pivoted into the operational position 164 (FIG. 7). That is, the cartridge seat 126 faces the cartridge recess 150 (FIG. 7). In the operational position 164, the first latch portion 184 on the cartridge 130 can selectively latch with the second latch portion 186 to at least temporarily latch the cartridge 130 in the operational position 164. To that end, when the cartridge 130 is received within the cartridge seat 126, the open face 140 is uncovered. Further, a portion of the front cartridge wall 135 (FIG. 7) is visible. However, remainder portions of the cartridge 130 such as the second coupling 134 (FIG. 7) are concealed by the cartridge carrier 124 and the cartridge recess 150 in the operational position 164. Once the cartridge 130 with the cartridge carrier 124 are in the operational position 164 and the cartridge 130 is securely latched, a cycle of operation of article treating can commence (FIG. 7). To remove the cartridge 130 from the cartridge receptacle 120, the first latch portion 184 is unlatched, and the biasing device 160 biases the cartridge carrier 124 from the operational position 164 (FIG. 7) to the load position 162 (FIG. 6). In the load position 162, the cartridge 130 can be removed or uncoupled from the cartridge carrier 124 (FIG. 5).

In some implementations, the second coupling 134 of the cartridge 130 can be coupled to or engage with the first coupling 158 whenever the cartridge 130 is in the seated position, regardless of the positioning of the cartridge carrier 124 (FIGS. 6 and 7). In other implementations, the second coupling 134 can be coupled to the first coupling 158 once the dispenser assembly 118 is in the operational position 164 (FIG. 7). Regardless of where the fluid coupling is made, the first coupling 158 can provide a fluidic connection between the treating chemistry reservoir 132 and the second coupling 134, such that treating chemistry may be supplied to the treating chamber 16 (FIG. 1) from the cartridge 130.

For instance, in one non-limiting example of operation, a valve 188 (FIG. 7). can be provided with the dispenser assembly 118 for selectively coupling the first coupling 158 to the pump 63. In such a case, the valve 188 can be closed when the dispenser assembly 118 is in the load position 162 and open when the dispenser assembly 118 is in the operational position 164. In this manner, when the cartridge 130 is in the seated position 168 and the cartridge carrier 124 is in the load position 162, the second coupling 134 can couple to the first coupling 158 and the valve 188 can remain closed. When the cartridge carrier 124 is moved into the operational position 164 and the cartridge 130 is in the seated position 168, the valve 188 can be opened.

In another non-limiting example of operation, the first coupling 158 can be aligned such that fluid coupling is made with the second coupling (FIGS. 6 and 7). In such a case, fluidic connection between the treating chemistry reservoir 132 and the pump 63 can occur after the cartridge 130 is inserted into the cartridge seat 126, and the cartridge seat 126 faces the cartridge recess 150.

Aspects of the disclosure provide for several benefits, including that the cartridge can be secured or coupled to the treating chamber without need of a hinged or rotatable lid connected to the treating chamber surface. The use of a cartridge carrier provides for guided access to the cartridge while maintaining a compact, hidden form within the treating chamber when in the operational position, which maximizes available space for articles within the treating chamber. In addition, the lack of a hinged or rotatable lid connected to the treating chamber surface can provide a more intuitive removal and insertion of the cartridge into the cartridge carrier.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

Further aspects of the disclosure are provided by the subject matter of the following clauses:

What is claimed is:

1. A household appliance for treating articles according to an automatic cycle of operation, the household appliance comprising:

a chassis having an interior surface at least partially defining a treating chamber for receiving the articles for treatment according to the automatic cycle of operation, the chassis including a door assembly having an inner door surface forming part of the interior surface of the chassis; and a dispenser assembly operably coupled to the inner door surface, the dispenser assembly comprising:

a cartridge receptacle having a rear wall from which extends a peripheral wall to define a cartridge recess with an open face opposite the rear wall; and a cartridge carrier defining a cartridge seat and movable relative to the inner door surface between an operational position, where the cartridge seat faces the cartridge recess, and a load position, where the cartridge seat faces the open face.

2. The household appliance of claim 1, wherein the cartridge carrier is pivotally mounted and pivots between the operational position and the load position.

3. The household appliance of claim 2, wherein the cartridge carrier is hingedly mounted to the peripheral wall.

4. The household appliance of claim 3, further comprising a biasing device biasing the cartridge carrier from the operational position to the load position.

5. The household appliance of claim 4, further comprising a pump fluidly coupled to the cartridge seat in at least the operational position.

6. The household appliance of claim 1, wherein the cartridge carrier has a height that is less than 50% of a height of the cartridge recess.

7. The household appliance of claim 1, wherein the open face is open when a cartridge is received within the cartridge seat and the cartridge carrier is in the load position.

8. The household appliance of claim 7, wherein the open face is closed when a cartridge is received within the cartridge seat and the cartridge carrier is in the operational position.

9. The household appliance of claim 1, wherein the cartridge carrier has a height that is less than 50% of a height of the cartridge recess.

10. A household appliance for treating articles according to an automatic cycle of operation, the household appliance comprising:

a chassis having an interior surface at least partially defining a treating chamber for receiving the articles for treatment according to the automatic cycle of operation, the chassis including a door assembly having an inner door surface forming part of the interior surface of the chassis; and a dispenser assembly operably coupled to the inner door surface, the dispenser assembly comprising:

a cartridge receptacle having a rear wall from which extends a peripheral wall to define a cartridge recess with an open face opposite the rear wall;

a cartridge carrier defining a cartridge seat with a first coupling and the cartridge carrier is movable relative to the inner door surface between an operational position, where the cartridge seat faces the cartridge recess, and a load position, where the cartridge seat faces the open face; and a cartridge sized to fit within the cartridge recess and having a second coupling that couples with the first coupling to secure the cartridge within the cartridge seat.

11. The household appliance of claim 10, wherein the first coupling and the second coupling are fluid couplings that establish fluid communication between the cartridge and the household appliance.

12. The household appliance of claim 11, wherein one of the first coupling or second coupling is a cannula and the other of the first coupling and the second coupling is a seal through which the cannula passes.

13. The household appliance of claim 12, wherein the seal is a membrane.

14. The household appliance of claim 12, further comprising a pump fluidly coupled to one of the first coupling or the second coupling.

15. The household appliance of claim 10, wherein the cartridge carrier is pivotally mounted and pivots between the operational position and the load position.

16. The household appliance of claim 15, further comprising a biasing device biasing the cartridge carrier from the operational position to the load position.

* * * * *